United States Patent [19]

Petro

[11] Patent Number: 4,569,367

[45] Date of Patent: Feb. 11, 1986

[54] HYDRAULIC VALVE INLET UNLOADERS

[75] Inventor: John D. Petro, Hubbard, Ohio

[73] Assignee: Commercial Shearing, Inc., Youngstown, Ohio

[21] Appl. No.: 691,474

[22] Filed: Jan. 14, 1985

[51] Int. Cl.[4] ..... F15B 13/08

[52] U.S. Cl. ..... 137/596.13; 137/596.12

[58] Field of Search ..... 137/110, 596.12, 596.13

[56] References Cited

U.S. PATENT DOCUMENTS

| | | | |
|---|---|---|---|
| 3,718,159 | 2/1973 | Tennis | 137/596.12 |
| 3,771,558 | 11/1973 | Ailshie | 137/596.13 |
| 4,139,021 | 2/1979 | Ailshie et al. | 137/596.13 |
| 4,178,962 | 12/1979 | Tennis | 137/596.13 |

FOREIGN PATENT DOCUMENTS

| | | | |
|---|---|---|---|
| 2335702 | 1/1974 | Fed. Rep. of Germany | 137/596.13 |

*Primary Examiner*—Gerald A. Michalsky

*Attorney, Agent, or Firm*—Buell, Ziesenheim, Beck & Alstadt

[57] ABSTRACT

An inlet unloader valve is provided for insertion ahead of one or more open center valve work sections having a pressure beyond port, which unloader valve has a spring biased spool, normally closing communication from the inlet to exhaust and proportionally opened by signal pressure from the pressure beyond port and the inlet and exhaust chambers to control flow through the work sections.

10 Claims, 4 Drawing Figures

HYDRAULIC VALVE INLET UNLOADERS

This invention relates to hydraulic valve inlet unloaders and particularly to an inlet unloader which is capable of functioning with any number of open center work sections in which the open center pressure drop through the valve assembly can be held to a minimum.

The present invention provides an inlet unloader spool structure that will permit the inlet flow from a source of fluid pressure to be divided into two flows, a signal flow and a main flow. The main flow is directed from the inlet core to the tank core when all work sections are in neutral. The signal flow is directed by way of the open center to one end of the unloader spool end opposite a preload spring at the other end, then to tank, when all work sections are in their neutral position.

The inlet unloader circuit of this invention when used with one or more standard open center valves, will increase the flow range of such valves without increased open center pressure drop and with decreased spool forces since only the signal flow is metered on the work section spool in the open center position.

I provide an inlet unloader valve for insertion ahead of one or more open center hydraulic valve work sections having a pressure beyond port following the last work section comprising a housing, an inlet chamber in said housing, an exhaust chamber in said housing spaced from the inlet chamber, a bore extending from one end of said housing through said inlet and outlet chambers, a valve spool slidably positioned in said bore, an inlet port connected to said inlet chamber for delivering pressure from a source of fluid pressure, an outlet port connected to said inlet chamber for delivering fluid in said inlet chamber to an open center passage of a work section, an exhaust port in said housing connected to said exhaust chamber for delivery of fluid to tank, a signal port in the housing connected to said bore at said one end of the housing delivering signal pressure fluid from said pressure beyond port against one end of the valve spool, resilient means in the bore acting on the other end of the spool biasing the spool toward said one end of the housing, first metering means in the spool connecting said inlet and exhaust chambers with the said other end of the spool, second metering means in the spool connecting the exhaust chamber with said one end of the spool, at least one normally closed signal metering notch on said one end connected to said second metering means and an annular recess in said spool intermediate its ends defining a normally closed transfer passage from the inlet to the exhaust chamber. Preferably the resilient means is a spring acting on the other end of the spool. The first metering means is preferably a first passage extending axially of said spool from said other end of the spool to a point intermediate its ends with metering orifices through the spool wall to the inlet and exhaust chambers. The second metering means in the spool is preferably a second passage extending axially of said spool from said one end to a point spaced from the first passage with a metering orifice through the spool wall to the exhaust chamber.

In the foregoing general description of my invention, I have set out certain objects, purposes and advantages of this invention. Other objects, purposes and advantages of this invention will be apparent from a consideration of the following description and the accompanying drawings in which.

Figure 1:
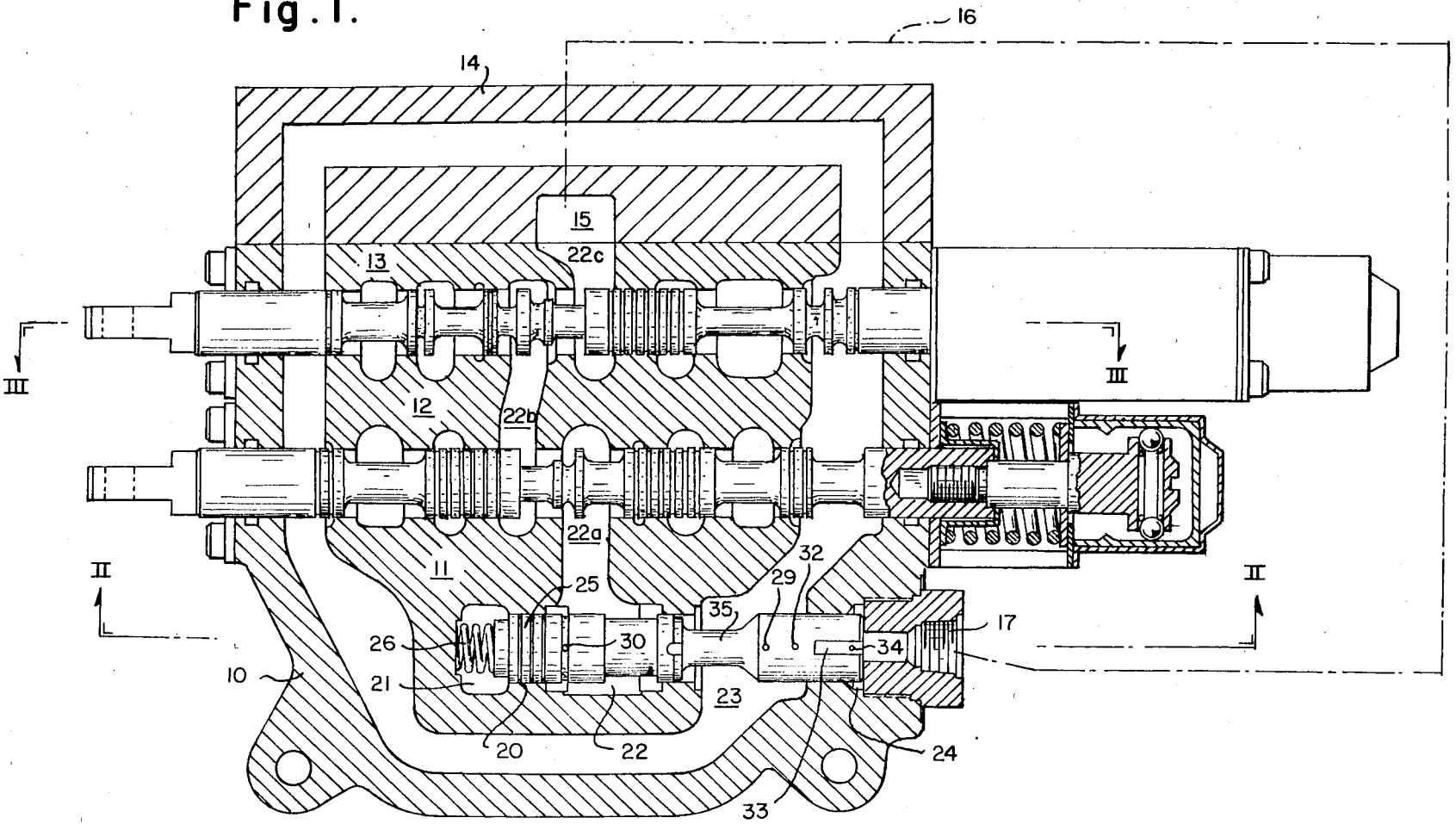
FIG. 1 is a section of a valve assembly incorporating the inlet unloader valve of this invention with a pair of open center work sections and a standard pressure beyond outlet section.

Referring to the drawings, I have illustrated a monoblock open center valve assembly in a housing 10 having an inlet section 11, two downstream open center work sections 12 and 13 and a standard pressure beyond outlet section 14.

The first work section 12 is an open center parallel four-position float of standard configuration. The second work section 13 is an open center parallel four-position generation section as shown. The circuits of each of these work sections can be changed to single acting or double acting open center valves by replacing the spools and end cap components as is well known in the art.

The pressure beyond section 14 is a standard section with an orifice 15 connected to a line 16 carrying a signal flow to a signal port 17 in the end of housing 10 at the inlet section 11.

The inlet section 11 is provided with a bore 20 intersected by a spring chamber 21, an inlet chamber 22 which connects with open center passages **22*a*, 22*b* and 22*c* of work sections 12 and 13 and outlet port 15, an exhaust chamber 23 and a signal chamber 24 spaced apart along the length of the bore 20. A spool 25, slidable lengthwise of the bore, is biased to the signal chamber end of the bore by a spring 26 in spring chamber 21. Spring 26 extends into a first axial bore 27 in the end of spool 25. A reduced axial bore 28 continues from bore 27 and communicates through orifice 29 with exhaust chamber 23. An orifice 30 communicates through the spool wall from bore 28 to inlet chamber 22 when spool 25 is in neutral position as shown. A second bore 31 extends axially into the opposite end of spool 25 and communicates with the exhaust chamber through orifice 32 in the spool wall. This opposite end of the spool is also provided with one or more signal meter notches 33 in the surface of the spool which communicate with the second axial bore 31 through orifices 34. An annular recess 35 is provided intermediate the ends of spool 25 defining a passage for fluid from inlet chamber 22 to exhaust chamber 23 when the spool is moved to the left viewing FIGS. 1 and 2**.

An inlet port 36, connected to inlet chamber 22, is provided in the housing at one side. An outlet port 37 is spaced from the inlet port and communicates with exhaust chamber 23.

Figure 2:
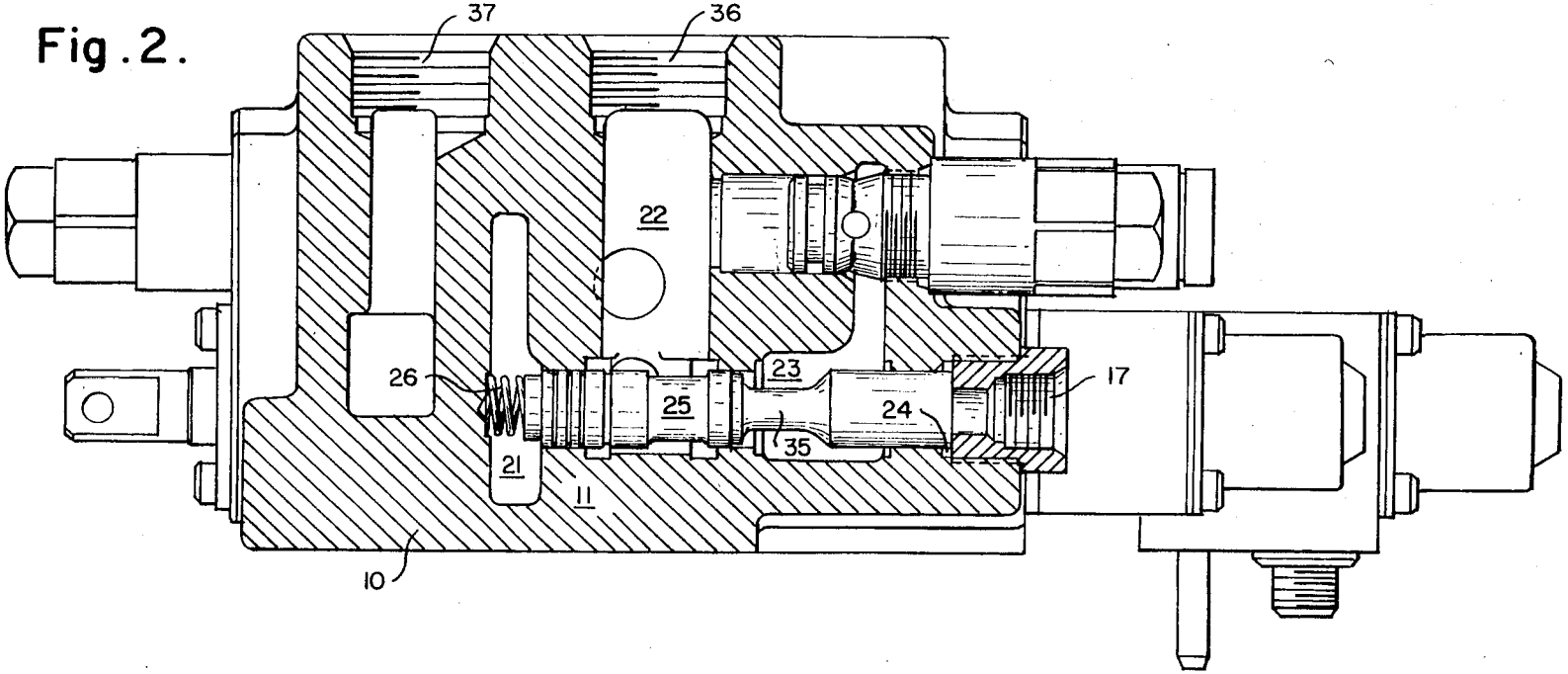
FIG. 2 is a section on the line II—II of FIG. 1.
Figure 4:
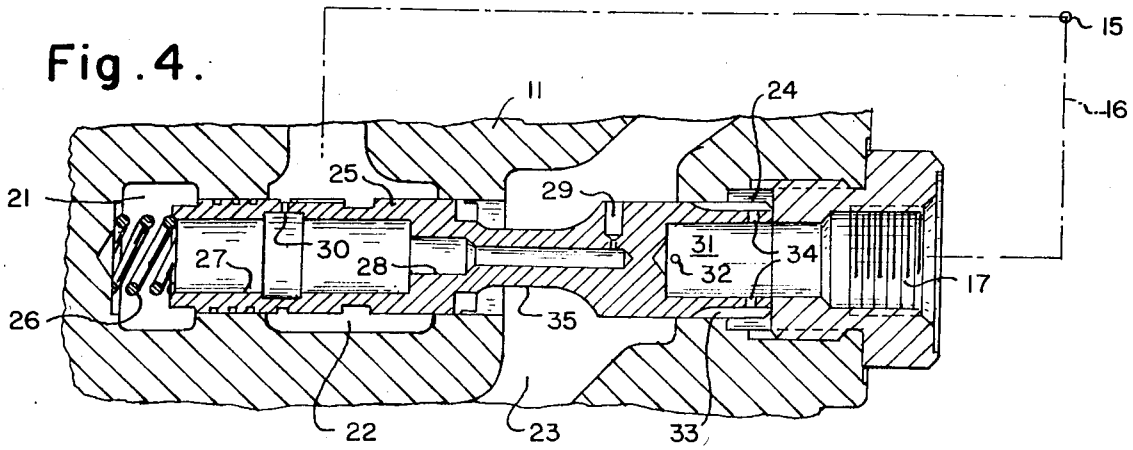
FIG. 4 is a longitudinal section through the inlet unloader spool of this invention.
Figure 3:
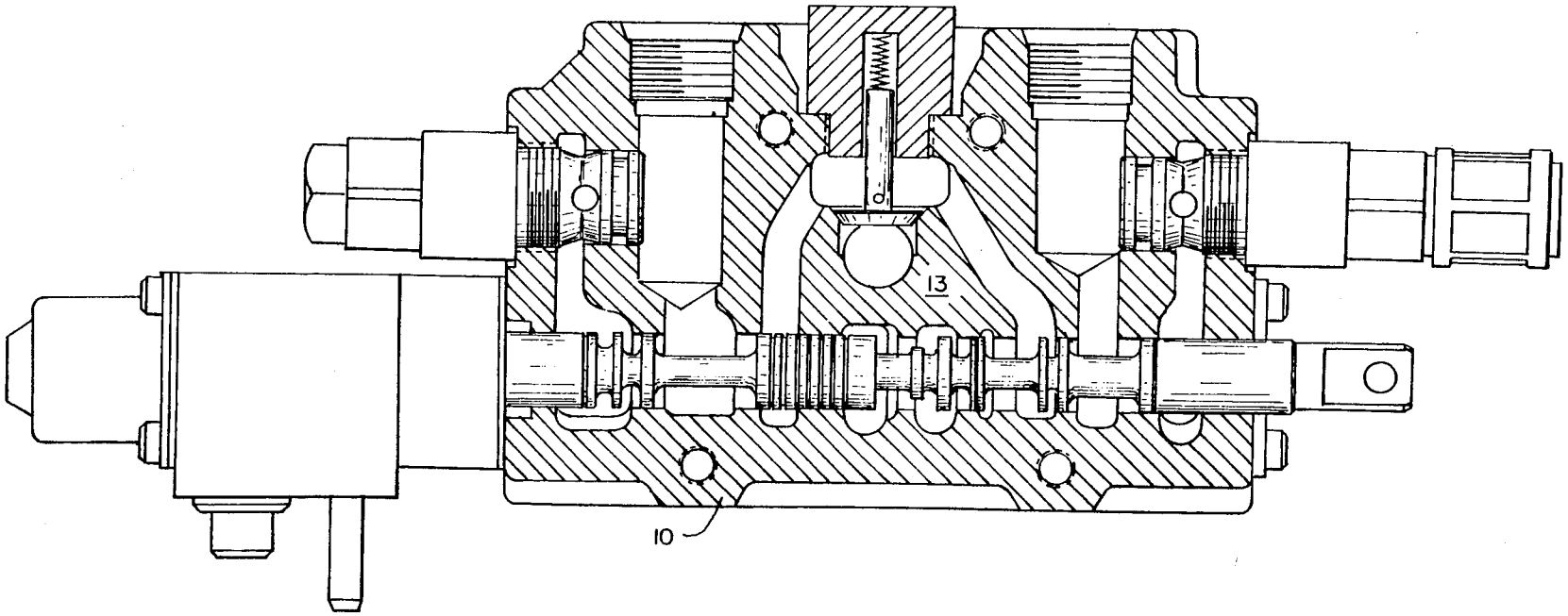
FIG. 3 is a section on the 1ine III—III of FIG. 1.

In operation with all open center work spools neutral as shown in FIG. 1, a pump (not shown) connected to inlet port 36 delivers fluid pressure through inlet chamber 22 through the open center passages of work sections 12 and 13 to the pressure beyond section 14 in unrestricted fashion. Pressure flow then passes through orifice 15 in the pressure beyond section, through line 16 to signal port 17 in the end of bore 20. At this point the pressure in the open center passages and signal line 16 increases until the force generated in the signal port 17 on the end of spool 25 is greater than the load of spring 26 and the force due to pressure fluid in chamber 21 on the other end of spool 25. When the point arrives, the unloader spool 25 will shift compressing spring 26 and permitting the majority of pressure fluid entering inlet chamber 22 to pass through annular recess 35 to the exhaust chamber 23 and thence out port 37 to tank. The remainder of the flow entering the inlet chamber 22 is also passed to tank as a signal flow through metering slots 33 on the end of unloader spool 25. The force acting on the end of spool 25 at spring chamber 21 is maintained at a pressure lower than that at signal port chamber 24 by fluid passing through orifices 29 and 30 and axial bores 27 and 28. Thus, when the work section spools are in neutral, the unloading spool 25 can shift and open inlet chamber 22 to outlet chamber 23 at a predetermined inlet pressure thereby dumping inlet fluid directly to tank.

The pressure reflected on the end of spool 25 in spring chamber 21 is a predetermined percentage of the pressure in inlet chamber 22 that is controlled by the area ratio of orifices 29 and 30. Since the pressure in chamber 21 is a ratio of the inlet pressure, the force on the end of spool 25 in chamber 21 will increase as any work section spool is activated, closing off or restricting the open center signal flow. When the open center signal flow to orifice 15, line 16 and signal port 17 is restricted, the unloader spool 25 will start to close and restrict the flow to tank through annular recess 34 and allowing the operator of the valve to meter flow to the work load as required. In order to obtain an intermediate metering position of the unloader spool 25, the pressure level is increased in the spring chamber acting on the end of spool 25 therein to force spool 25 to close at the same time the signal pressure is increased by restricting signal flow by means of a variable metering notch 33 on the signal port chamber end of the unloading spool. The resulting creation of opposing forces causes the unloader spool 25 to find an equilibrium metering position determined by the movement of a work section spool.

When a work signal spool is fully activated, the open center signal path is blocked except for leakage, therefore orifice 32 is placed at the signal port chamber end of spool 25 to permit open center leakage flow to escape to the tank. This prevents the unloader spool 25 from opening when a work section is fully activated.

Since the force levels acting on the opposite ends of spool 25 are high during the metering mode, the effects of the spool forces generated by the main flow being metered from the inlet chamber to the outlet chamber and thence to tank are minimized.

Since only a small signal flow is permitted to pass through open center, a low inlet to outlet pressure drop can be obtained with the system of this invention. This, in turn, permits the use of a smaller size valve without an increase in open center pressure drop.

In the foregoing specification I have set out certain preferred practices and embodiments of this invention. However, it will be understood that this invention may be otherwise embodied within the scope of the following claims.

I claim:

1. An inlet unloader valve for insertion ahead of one or more open center valve work sections having a pressure beyond port following the last work section, comprising a housing, an inlet chamber in said housing intermediate its ends, an exhaust chamber in said housing spaced from the inlet chamber, a bore extending from one end of said housing through said inlet and exhaust chambers, a valve spool slidably positioned in said bore, an inlet port in the housing connected to said inlet chamber for delivering pressure from a source of fluid pressure, an outlet port in the housing connected to said inlet chamber for delivering fluid in the inlet chamber to an open center passage of a work section, an exhaust port in said housing connected to the exhaust chamber for delivery of fluid to tank, a signal port in the housing connected to said bore at said one end of said housing for delivering signal pressure fluid from said pressure beyond port against one end of the valve spool, resilient means in the bore acting on the other end of the spool normally urging the spool toward said one end of the housing, first metering means in said spool connecting said inlet and exhaust chambers with the said other end of the spool, a second metering means in said spool connecting the exhaust chamber with said one end of the spool, at least one signal metering notch on the one end of said spool normally closed by the bore and connected to said second metering means and an annular recess in said spool intermediate its ends defining a normally closed transfer passage from the inlet chamber to the exhaust chamber.

2. An inlet unloader valve as claimed in claim 1 wherein the resilient means is a spring.

3. An inlet unloader valve as claimed in claim 1 or 2 wherein the first metering means includes a first passage extending axially of said spool from the resilient means to a point intermediate the spool ends having metering orifices through the wall to the inlet and exhaust chambers with the spool in neutral position.

4. An inlet unloader valve as claimed in claim 3 wherein said first passage has a larger portion at the end opening to the resilient means adapted to receive the resilient means.

5. An inlet unloader as claimed in claim 4 wherein a resilient means chamber is provided in the housing intersecting the bore on the side of the inlet chamber opposite the exhaust chamber and a signal chamber is provided in the housing intersecting the bore on the side of the exhaust chamber opposite the inlet chamber.

6. An inlet unloader valve as claimed in claim 4 wherein the second metering means in the spool is a second passage extending axially of the spool from the end opposite the resilient means and having an orifice through the spool wall communicating with the exhaust chamber.

7. An inlet unloader as claimed in claim 3 wherein a resilient means chamber is provided in the housing intersecting the bore on the side of the inlet chamber opposite the exhaust chamber and a signal chamber is provided in the housing intersecting the bore on the side of the exhaust chamber opposite the inlet chamber.

8. An inlet unloader valve as claimed in claim 3 wherein the second metering means in the spool is a second passage extending axially of the spool from the end opposite the resilient means and having an orifice through the spool wall communicating with the exhaust chamber.

9. An inlet unloader as claimed in claim 1 or 2 wherein a resilient means chamber is provided in the housing intersecting the bore on the side of the inlet chamber opposite the exhaust chamber and a signal chamber is provided in the housing intersecting the bore on the side of the exhaust chamber opposite the inlet chamber.

10. An inlet unloader valve as claimed in claim 1 or 2 wherein the second metering means in the spool is a second passage extending axially of the spool from the end opposite the resilient means and having an orifice through the spool wall communicating with the exhaust chamber.

* * * * *

UNITED STATES PATENT AND TRADEMARK OFFICE

CERTIFICATE OF CORRECTION

PATENT NO. : 4,569,367

DATED : February 11, 1986

INVENTOR(S) : JOHN D. PETRO

It is certified that error appears in the above-identified patent and that said Letters Patent is hereby corrected as shown below:

Column 2, line 54, after spools, insert --in--.

Column 4, line 64, delete "second".

Signed and Sealed this

*Third* Day of *June 1986*

[SEAL]

*Attest:*

DONALD J. QUIGG

*Attesting Officer*

*Commissioner of Patents and Trademarks*